US007004809B2

(12) United States Patent
Yang

(10) Patent No.: US 7,004,809 B2
(45) Date of Patent: Feb. 28, 2006

(54) ILLUMINANT FOR DISCHARGE LAMP

(76) Inventor: Bing Lin Yang, Otsu Bldg. 101, 5-6, Sumiyoshi 2-chome, Koto-ku, Tokyo 135-0002 (JP)

( * ) Notice: Subject to any disclaimer, the term of this patent is extended or adjusted under 35 U.S.C. 154(b) by 0 days.

(21) Appl. No.: 09/919,552

(22) Filed: Jul. 31, 2001

(65) Prior Publication Data

US 2002/0195941 A1 Dec. 26, 2002

(30) Foreign Application Priority Data

Jun. 25, 2001 (JP) ..... 2001-191606

(51) Int. Cl.
*H01T 21/02* (2006.01)

(52) U.S. Cl. ..... 445/17

(58) Field of Classification Search ..... 313/623, 313/625, 574, 491, 631, 632; 445/17
See application file for complete search history.

(56) References Cited

U.S. PATENT DOCUMENTS

| | | | | |
|---|---|---|---|---|
| 3,114,855 | A | 12/1963 | Story | |
| 3,908,252 | A * | 9/1975 | Willems | 445/51 |
| 3,916,241 | A * | 10/1975 | Pollard | 313/623 |
| 4,001,625 | A * | 1/1977 | Schat et al. | 313/623 |
| 4,221,987 | A * | 9/1980 | Kerekes | 313/42 |
| 5,061,877 | A * | 10/1991 | Akanuma | 313/631 |
| 5,331,249 | A * | 7/1994 | Minamikata et al. | 313/632 |
| 5,751,111 | A | 5/1998 | Stoffels et al. | |
| 5,880,559 | A * | 3/1999 | Fox et al. | 313/632 |
| 5,973,453 | A * | 10/1999 | Van Vliet et al. | 313/623 |
| 6,057,635 | A * | 5/2000 | Nishimura et al. | 313/25 |
| 6,157,130 | A | 12/2000 | Omori et al. | 313/634 |
| 6,172,453 | B1 * | 1/2001 | Hamada et al. | 313/633 |
| 6,259,205 | B1 * | 7/2001 | Wijenberg et al. | 313/625 |
| 6,824,438 | B1 * | 11/2004 | Park et al. | 445/24 |

FOREIGN PATENT DOCUMENTS

| | | |
|---|---|---|
| EP | 0378338 | 7/1990 |
| EP | 0467713 | 1/1992 |
| EP | 1020887 | 7/2000 |
| GB | 2 124 822 A | 2/1984 |
| JP | 57-121143 | 7/1982 |
| JP | 59-29349 | 2/1984 |
| JP | 60-025145 | 2/1985 |

(Continued)

OTHER PUBLICATIONS

European Search Report for Application No. 01118433.0-1242- dated Oct. 23, 2003.

(Continued)

*Primary Examiner*—Joseph Williams
*Assistant Examiner*—Peter Macchiarolo
(74) *Attorney, Agent, or Firm*—Cantor Colburn LLP

(57) ABSTRACT

A durable illuminant with simple structure and stable discharge characteristics is provided. Discharge electrodes fixed to respective sealing spacers are inserted into a housing from both ends, the housing constructed from a cylindrical glass material with equal inner radii at both open ends. A discharge chamber is filled with a discharge gas and the sealing spacers are fused and fixed to the housing at this condition.

3 Claims, 11 Drawing Sheets

FOREIGN PATENT DOCUMENTS

| | | |
|---|---|---|
| JP | 60-028131 | 2/1985 |
| JP | 60-063871 | 4/1985 |
| JP | 5-217555 | 8/1993 |
| JP | 5-334989 | 12/1993 |
| JP | 6-13029 | 1/1994 |
| JP | 2000-268774 | 9/2000 |

OTHER PUBLICATIONS

Canadian Office Action; Application No. 2,354,428; Mailing date of Apr. 16, 2003.

Notice of Grounds for Rejection; Patent Application No. 2001-191606; Mailing date of Apr. 22, 2003.

* cited by examiner

ILLUMINANT FOR DISCHARGE LAMP

BACKGROUND OF THE INVENTION

1. Field of the Invention

The present invention relates to an illuminant for a discharge lamp, and in particular, to an illuminant for a discharge lamp which has simple structure, which lends itself to mass production, and which exhibits superior durability.

2. Description of the Related Art

Discharge lamps with high illumination efficiency are widely employed for general household or business use, as street lamps, as wall projection lamps, as lamps for advertisement or for illumination, in automobiles, and in cinematographs or projectors. In these various types of discharge lamps, discharge electrodes are placed to oppose each other in a discharge chamber filled with a discharge gas, and illumination effect is obtained by applying a predetermined voltage between the discharge electrodes to dissociate the discharge gas. Various illumination luminance and illumination colors or the like can be created by selecting the discharge gas employed, the pressure in the discharge chamber, or other characteristics.

Common discharge lamps have a structure wherein an illuminant is stored in an external glass tube, the open end of which is generally sealed by a socket for connecting a power source. Conventional illuminants require a complicated structure in order to obtain desired discharge characteristics and, thus, are not suited to mass-production. Consequently, there has been a problem that illuminants tend to be expensive. Moreover, while high durability is desired for a discharge lamp, a conventional discharge lamp has a tendency to easily be broken due to external impact or thermal load during use.

As a structure for such a conventional illuminant, an illuminant for a metal halide lamp which is one type of a discharge lamp is disclosed in Japanese Patent Laid-Open Publication No. Hei 5-217555. In this conventional apparatus, a pair of electrodes are inserted into a quartz illumination tube and the sealed discharge space section is filled with a predetermined amount of mercury, sodium iodide, scandium iodide, or the like, along with xenon which acts as the starting gas. Sealing sections are joined at both ends of the discharge space section. The electrodes and external lead lines are connected via metal foils provided on the sealing sections.

In this type of illuminant, there has been problems in that it is difficult to place the electrodes to oppose each other within the illumination tube at predetermined positions and that the positions of the electrodes in the tube change when both ends of the quartz illumination tube are pinch processed by heating the tube. Moreover, the junction between the discharge space section and sealing section requires complicated heat fusion steps, and therefore, various problems are also present in view of mass-productivity and durability.

In particular, the positional deviation of the opposing electrodes within the illuminant causes a problem that a desired focusing effect cannot be obtained due to the deviation of the position of the illumination source from a defined value when the discharge lamp is used as an automobile lamp, or a lamp for a cinematograph or for a projector.

SUMMARY OF THE INVENTION

The present invention is conceived to solve the above conventional problem, and one object of the present invention is to provide an improved illuminant for a durable discharge lamp having a simple, readily mass-produced structure, in which the positions of the opposing electrodes can be accurately determined.

In order to solve at least one of the problems described above, according to the present invention, there is provided an illuminant for a discharge lamp, comprising a housing constructed from a cylindrical transparent material having equal inner radii at both open ends; a pair of discharge electrodes inserted from both ends of the housing into the housing and placed to oppose each other separate by a predetermined gap; and sealing spacers each of which has an outer radius approximately equal to or slightly smaller than the inner radius of the housing and onto which respective electrode axis of each discharge electrode is fixed, the fixing position of the sealing spacer within the housing being adjustable along the axial direction of the housing, wherein the sealing spacers are fixed to the housing at a condition where a discharge gas fills the discharge chamber defined by the housing and the sealing spacers, and at positions where the discharge electrodes are separated by a predetermined gap.

According to another aspect of the present invention, there is provided an illuminant for a discharge lamp, comprising a housing constructed from a cylindrical transparent material having equal inner radii at both open ends and a pair of discharge electrodes each of which has an outer radius approximately equal to or slightly smaller than the inner radius of the housing, the discharge electrodes inserted from both ends of the housing into the housing and having their fixing position within the housing adjustable along the axial direction of the housing, wherein the discharge electrodes are fixed within the housing, with a discharge gas filling the discharge chamber defined by the housing and the discharge electrodes and at positions where the discharge electrodes are separated by a predetermined gap.

According to another aspect of the present invention, it is preferable that a plate-like section be formed on the discharge electrode, for loading an additive material.

According to another aspect of the present invention, it is preferable that in an illuminant for a discharge lamp according to either claim 1 or 2, a projecting section is provided on the discharge electrode, for discharge start-up.

DESCRIPTION OF THE PREFERRED EMBODIMENTS

Preferred embodiments of the present invention will now be described with reference to the drawings.

Figure 1:
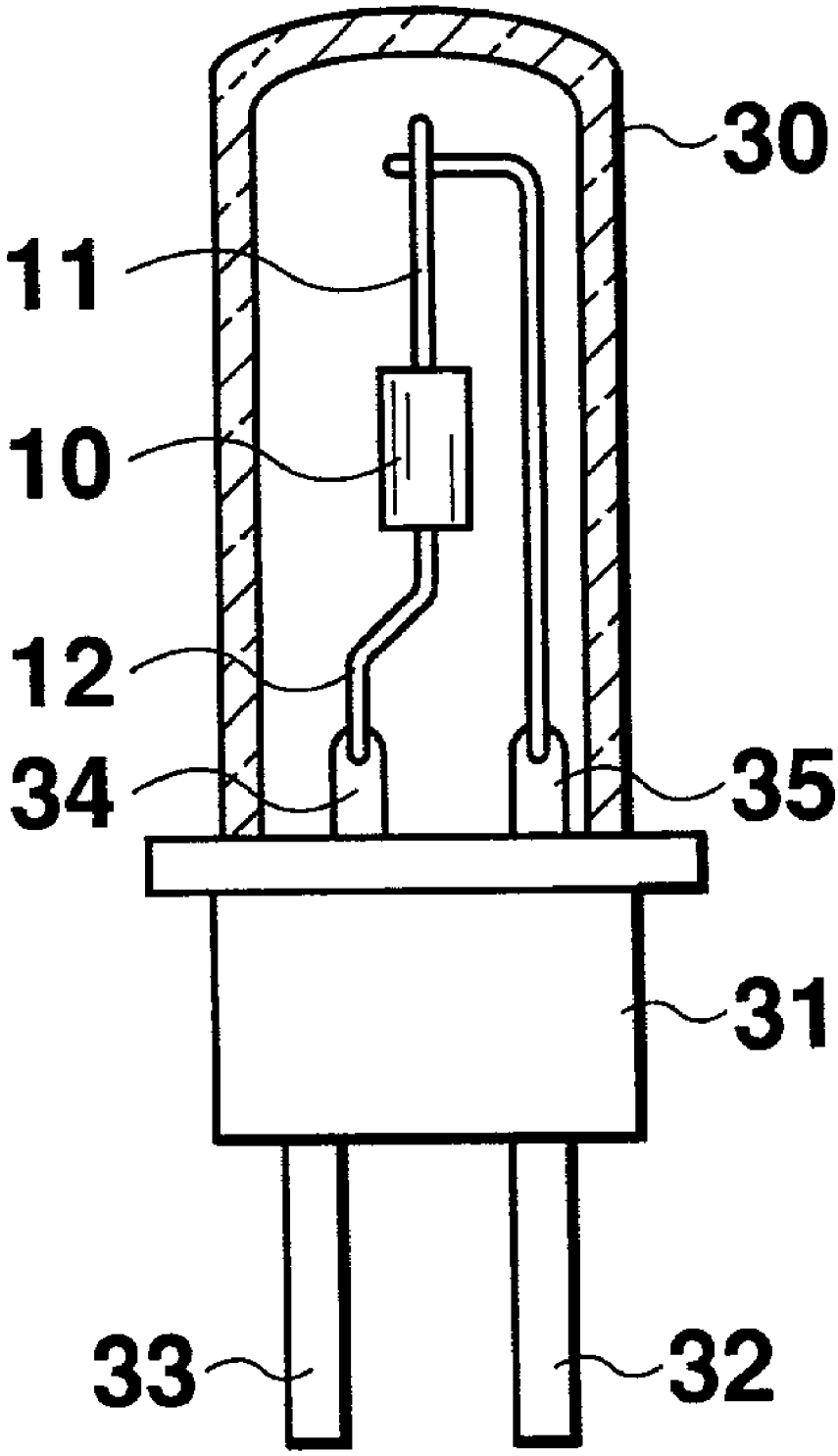
FIG. 1 is a partial sectional diagram showing an example discharge lamp having an illuminant according to the present invention.

FIG. 1 shows a metal halide lamp with an illuminant 10 according to the present invention. The lamp has a structure wherein the open end of an external glass tube 30 is sealed by a power source socket 31. Socket pins 32 and 33 are fixed to the power source socket 31 for connection to a power source. An illuminant 10 is stored inside the external glass tube 30. Electrode axes 11 and 12 provided on both ends of the illuminant 10 are electrically connected to the socket pins 32 and 33 via lead lines 34 and 35. The inside of the external glass tube 30 is filled with an inert gas.

Figure 2:
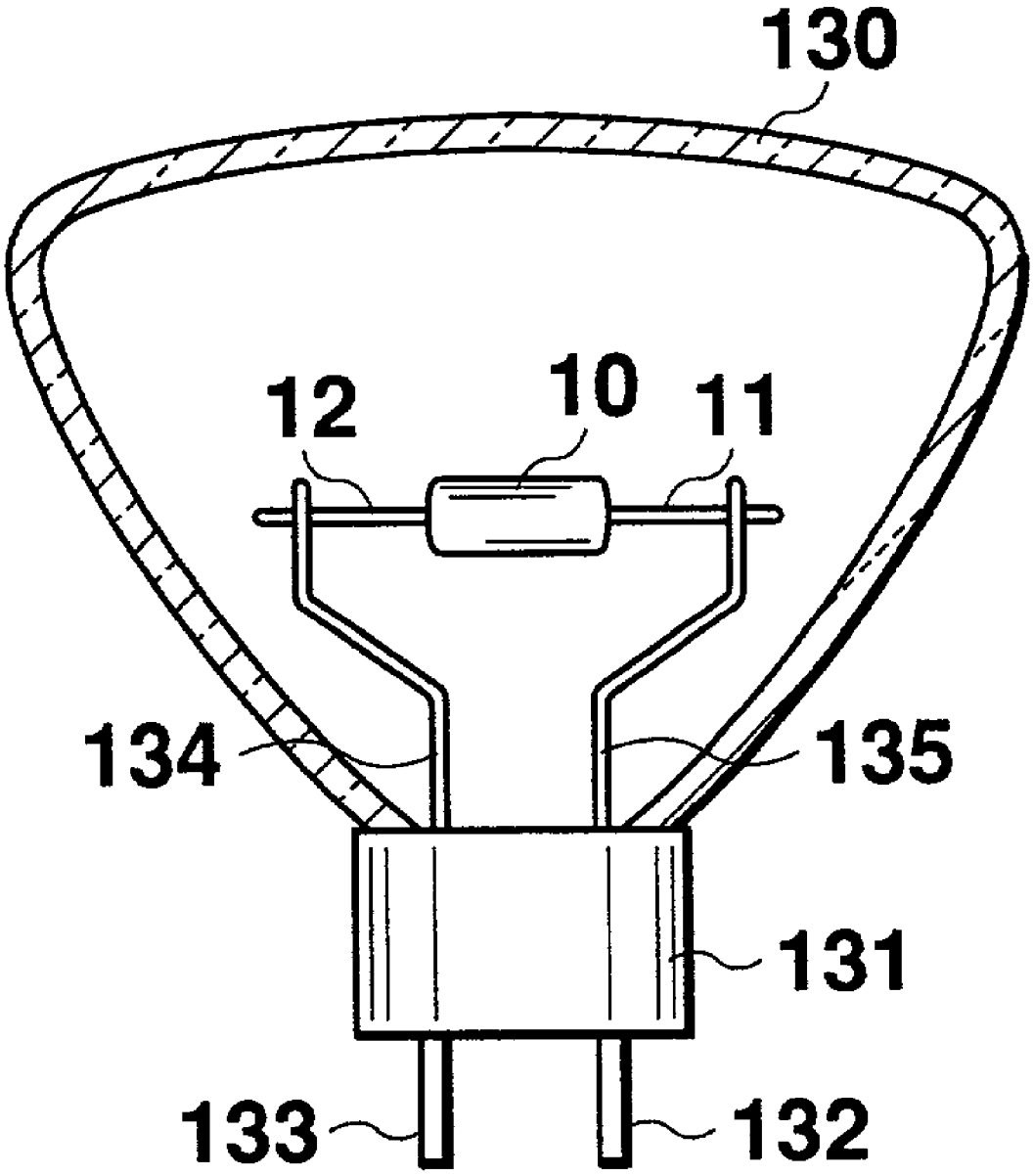
FIG. 2 is a partial sectional diagram showing an example automobile lamp having an illuminant according to the present invention.

FIG. 2 shows an automobile lamp with an illuminant 10 according to the present invention. The structures of the external glass tube 130 and socket 131 are similar to those shown in FIG. 1, and, thus, corresponding components are shown in FIG. 2 with reference numerals incremented by 100 from those used in FIG. 1 and detailed description of these corresponding components will not be repeated.

In the automobile shown in FIG. 2, or in other projection lamps, the position at which the illuminant 10 is fixed within the external glass tube 130 is of great importance, and a problem in that desired focusing cannot be obtained will result when the fixed position deviates from a predetermined position.

Figure 3:
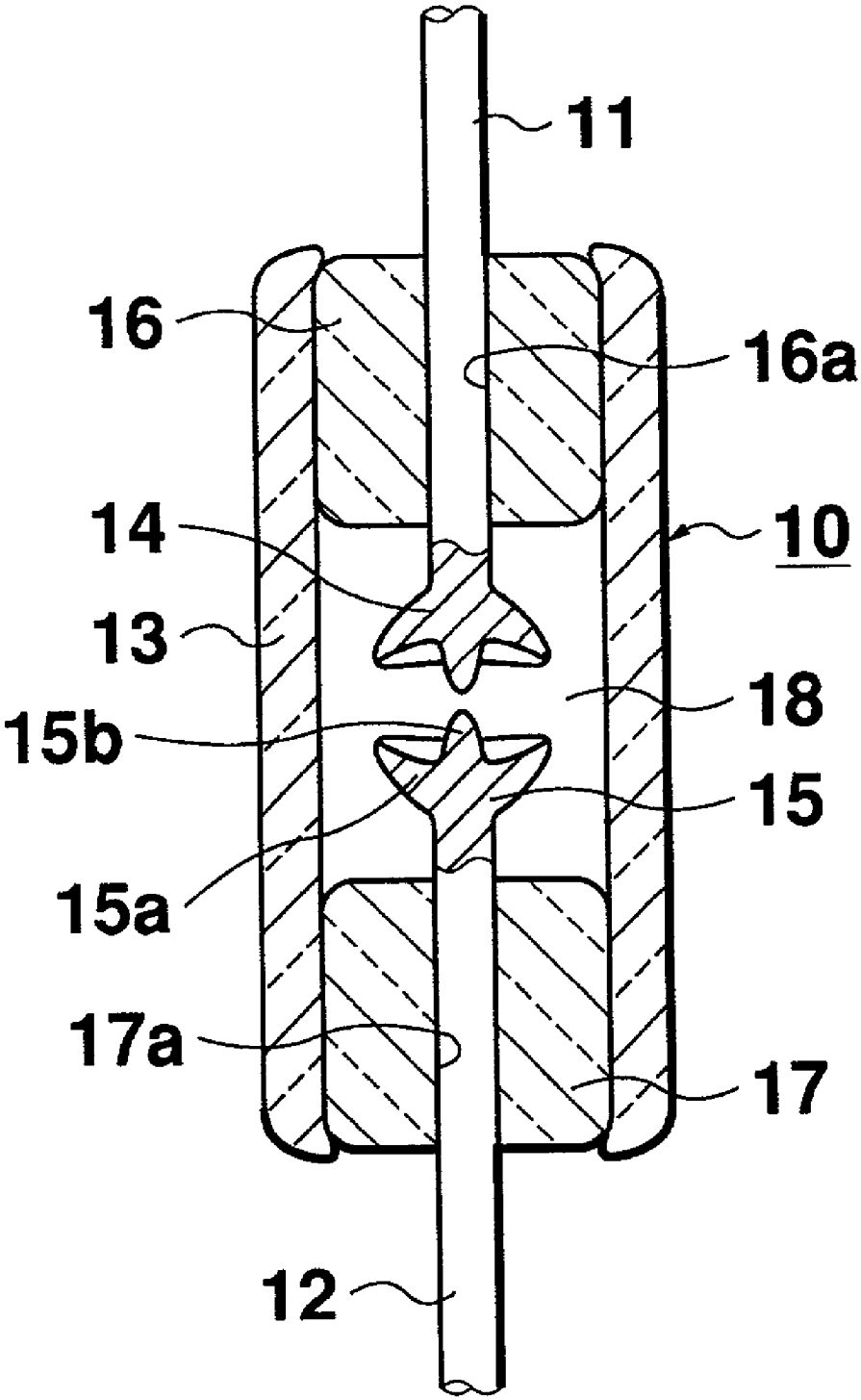
FIG. 3 is a cross-sectional diagram of an illuminant according to a first preferred embodiment of the present invention.

FIG. 3 shows an example illuminant 10 according to the present embodiment. A housing 13 is constructed from a cylindrical glass material having equal inner radii at both ends, which are open. It is preferable to use, for example, an international standard DO-34 type glass diode container having an inner radius of 0.66 mm as the housing 13. A great number of housings 13 can be very easily supplied by dividing a long cylindrical glass material into desired lengths.

A pair of discharge electrodes 14 and 15 are inserted into the housing 13 from both open ends and are placed to oppose each other such that a predetermined gap is maintained between the electrodes. The electrodes 14 and 15 are respectively joined to the electrode axes 11 and 12. The electrodes 14 and 15 and the electrode axes 11 and 12 can be constructed as an integral unit or can be constructed from different metals fused together. For example, it is preferable to construct the electrodes 14 and 15 from iron or iron alloy such as a molybdenum alloy and construct electrode axes 11 and 12 from dumet, and to fuse these components.

Each of the discharge electrode axes 11 and 12 is fixed to a respective sealing spacer 16 or 17. The sealing spacers 16 and 17 have a disc shape with a transparent hole 16*a* or 17*a* respectively formed at the center. The sealing spacers 16 and 17 are formed such that the outer radius of the sealing spacers 16 and 17 are approximately equal to or slightly smaller than the inner radius of the housing 13. As will be described below, respective discharge electrode axes 11 and 12 are inserted into the transparent holes 16*a* and 17*a* of respective sealing spacers 16 and 17. The structure is then heated so that the sealing spacers 16 and 17 are fused with and bonded to respective discharge electrodes 11 and 12.

According to the present invention, by having a housing 13 as a cylindrical transparent material with equal inner radii and forming the sealing spacers 16 and 17 with the outer radius approximately equal to or slightly smaller than the inner radius of the housing 13, it is possible to arbitrarily adjust the position of the sealing spacers 16 and 17, to which are fixed the discharge electrode axes 11 and 12, in the axial direction within the housing 13. Therefore, it is possible to fuse and fix the sealing spacers 16 and 17 and housing 13 by appropriate heating, in a condition where the gap between the discharge electrodes 14 and 15 is set at a predetermined value.

In this manner, a discharge chamber 18 is defined by the housing 13 and the sealing spacers 16 and 17 in a condition where the gap between the discharge electrodes 14 and 15 is set at a predetermined value. The discharge chamber 18 is filled with a desired discharge gas and sealed. The discharge gas is arbitrarily selected depending on the characteristics of the discharge lamp, from among noble gases such as xenon, argon, or the like. At the same time, additional materials such as metal halide, mercury, or the like may be sealed into the discharge chamber 18 as desired. Halide and mercury are, for example, useful in adjusting the starting voltage of the illuminant.

The fusion between the discharge electrode axes 11 and 12 and sealing spacers 16 and 17 and fusion between the sealing spacers 16 and 17 and the housing 13 as described can be performed by heating by burner or the like at a heating temperature of 350~1500° C. to obtain desired fusion and fixture. Here, by forming the discharge electrode axes 11 and 12 from dumet, it is possible to easily and reliably fuse the sealing spacers 16 and 17 and the discharge electrode axes 11 and 12. That is, dumet includes a coating material formed mainly from copper and nitrate coated onto the surface of an alloy wire of iron and nickel, which forms the core material. The dumet section and the sealing spacers 16 and 17 which are constructed from glass can be easily and firmly bonded.

Figure 4:
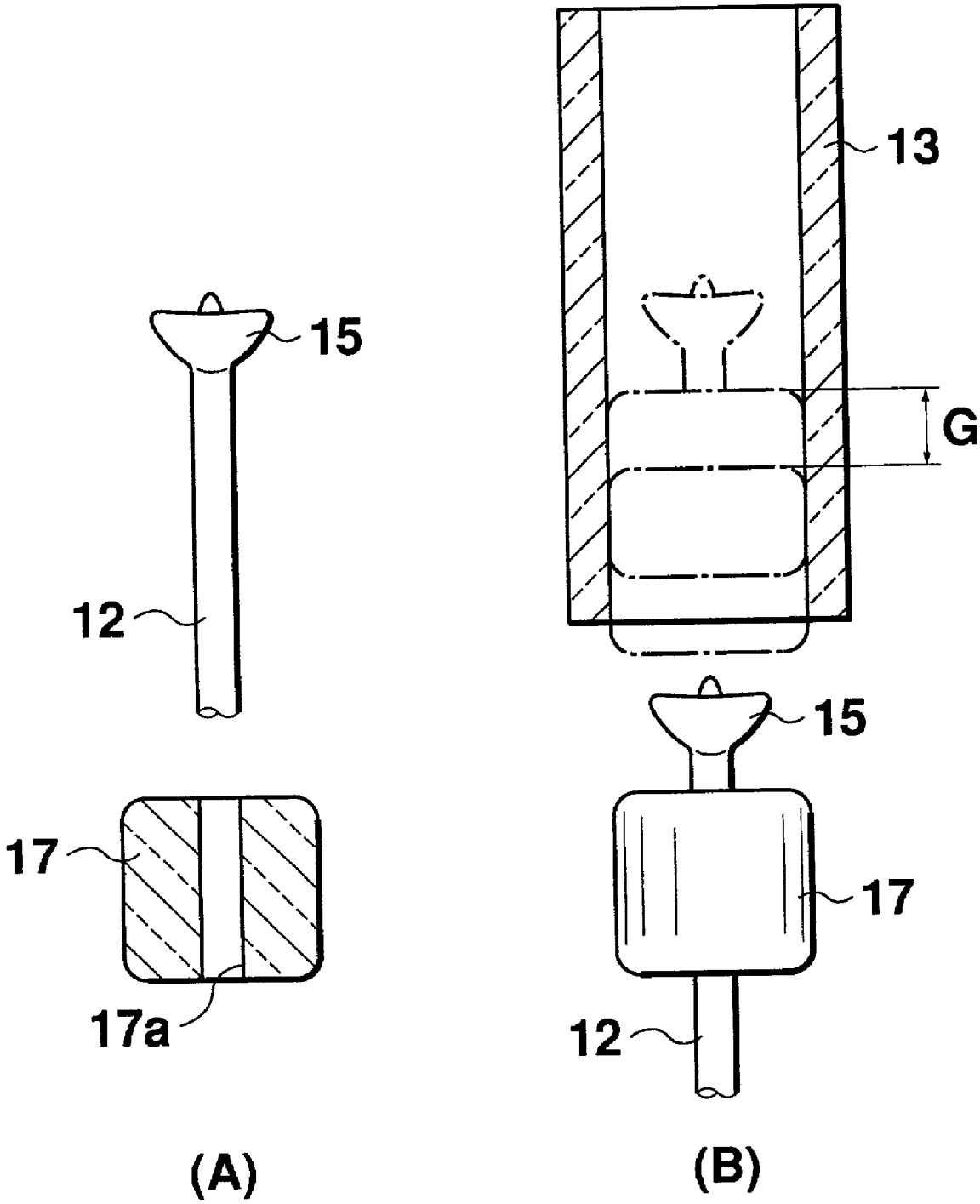
FIG. 4 is an explanatory diagram showing the assembly of the illuminant according to the first embodiment.

FIG. 4 shows a method for fixing the housing 13, discharge electrode 15, discharge electrode axis 12, and sealing spacer 17 according to the first embodiment.

As shown in FIG. 4A, the discharge electrode axis 12 is inserted into the transparent hole 17*a* of the sealing spacer 17 and heated to a predetermined heating temperature as described, such as, for example, a temperature between 350 and 1500° C. so that discharge electrode axis 12 and the sealing spacer 17 are firmly fused.

As shown in FIG. 4B, an electrode assembly formed by integrating the sealing spacer 17 and the discharge electrode 15 is dropped to the inside of the housing 13 supported at one of a plurality of jig holes provided on a jig. At this point, the positions of the sealing spacer 17 and the housing 13 along the axial direction are selected by setting the supporting position of the jig. As shown by a dotted line in FIG. 4B, the position in the axial direction is adjustable as shown by the letter G. According to the present invention, because the outer radius of the sealing spacer 17 is set to be approximately equal to or slightly smaller than the inner radius of the housing 13, insertion of the sealing spacer 17 into the housing 13 causes no problem. In reality, a plurality (for example, several hundreds) of housings 13 are placed at the lower mold of the jig, and sealing spacers 17 are dropped into the housings 13 at desired positions as described above.

Similarly, the upper mold of the jig holds a sealing spacer 16 in which the other discharge electrode 14 is fused and fixed. The upper and lower molds are positioned and contacted in this condition. Because the other sealing spacer 16 has its outer radius approximately equal to or slightly smaller than the inner radius of the housing 13, when the upper and lower molds contact each other, the other sealing spacer 16 held by the upper mold is also dropped into the housing 13, and the upper sealing spacer 16 drops in the vertical direction until the discharge electrode 14 contacts the other electrode 15.

Then, the upper sealing spacer 16 placed at the upper mold is pulled upward to create a predetermined spacing and that position is maintained. The mechanism for pulling upward, fixing, and maintaining can be any arbitrary mechanism, as long as the distance to be pulled upward can be managed to a desired precision. In this manner, when preparation is completed, the gap between the discharge electrodes 14 and 15 is accurately adjusted to a pre-calculated value.

Then, the upper and lower molds are introduced to a vacuum sealing device where cleaning, vacuum evacuation, and gas filling are performed based on a desired program. The sealing spacers 16 and 17 and the housing 13 are then heated along with the upper and lower molds. Normally, the sealing spacers 16 and 17 and the housing 13 are fused at a heated condition of 350~1500° C., and the sealing spacers 16 and 17 are firmly fused and fixed at both ends of the housing 13. According to the present invention, the position, within the jig, of the upper and lower discharge electrode axes 11 and 12 are accurately set during heating at a high temperature and during subsequent cooling, and the fusion by the housing 13 is performed while the gap between the electrodes is maintained. Thus, according to the present invention, a very accurate gap between the discharge electrodes can be obtained as shown in FIG. 3.

Therefore, according to the present invention, the gap between the discharge electrodes 14 and 15 can be arbitrarily adjusted by arbitrarily adjusting the maintenance gap between the sealing spacers 16 and 17 supported at the upper and lower molds. As a result, desired discharge characteristics can be obtained by the adjustment of the discharge gap.

The assembling operation is performed under an atmosphere of a predetermined discharge gas, and, consequently, a desired discharge gas fills and is sealed in the discharge chamber 18 of the fused illuminant 10.

Glass diode containers of other sizes, such as, for example, various glass diode containers from international standard DO-35 type (having an inner radius between 0.6 and 1.0 mm) and DO-41 type (having an inner radius of 1.53 mm) and large radius glass diode container having an outer radius of 9.0 mm can be used as the housing 13. It is therefore possible to arbitrarily and easily assemble an illuminant suitable for particular use using various sizes for the housing.

Moreover, although glass may be preferably used as the material for the housing 13 and sealing spacers 16 and 17, it is also possible to use other materials, such as, for example, plastics with sufficient translucence.

The sealing spacers 16 and 17 have a disc shape in the shown embodiment. However, it is also possible to use spherical spacers, and the airtight fixture of the sealing spacers 16 and 17 with the housing 13 can be performed using an arbitrary adhesive rather than heat fusion.

As described, according to the example of the first embodiment, the discharge electrodes 14 and 15 are respectively fused to the sealing spacers 16 and 17, and then the integrated electrode assemblies are fused or adhered and fixed to both ends of the housing 13. However, according to the present invention, the fusion between the sealing spacers, the discharge electrodes and the housing can be performed simultaneously. In such a case, the discharge electrode 14 and 15 and sealing spacers 16 and 17 are separately positioned and supported with respect to the housing 13.

As shown in FIG. 3, the electrodes 14 and 15 have a plate-like section 15*a* and projecting section 15*b* as the tip both when the electrodes 14 and 15 are formed integrally with the discharge electrode axes 11 and 12 and when the electrodes 14 and 15 and the discharge electrode axes 11 and 12 are formed as separate members and connected.

The plate-like section 15*a* is formed such that mercury or the like which is added can be placed on top of the plate-like section 15*a* when the discharge electrode 15 is vertically held. The additive material is not limited to mercury and can be any other halides, and these materials can be liquid or powder. By scooping or injecting a predetermined additive material by the plate-like section 15*a* of the discharge electrode 15, the amount determined by the size of the plate-like section 15*a* can be set as the constant addition amount. Thus, a very stable addition amount can be constantly supplied by the plate-like section 15*a*.

The plate-like section 15*a* not only functions as a sizing device for the additive material, but the outer periphery of the plate-like section 15*a* is also useful for securing stable discharge effect by cooperating with the projecting section 15*b* at the center of the discharge electrode 15. The discharge during the start-up begins from either the circular periphery of the plate-like section 15*a* or the tip of the projecting section 15*b*, and these parts function as a whole to continue to discharge with the other discharge electrode 14.

Moreover, the contact surface between the discharge electrode 15 and the discharge gas filling the discharge chamber 18 can be increased by the plate-like section 15*a*, and, consequently, the luminance and discharge efficiency during the discharge effect can be improved.

Figure 5:
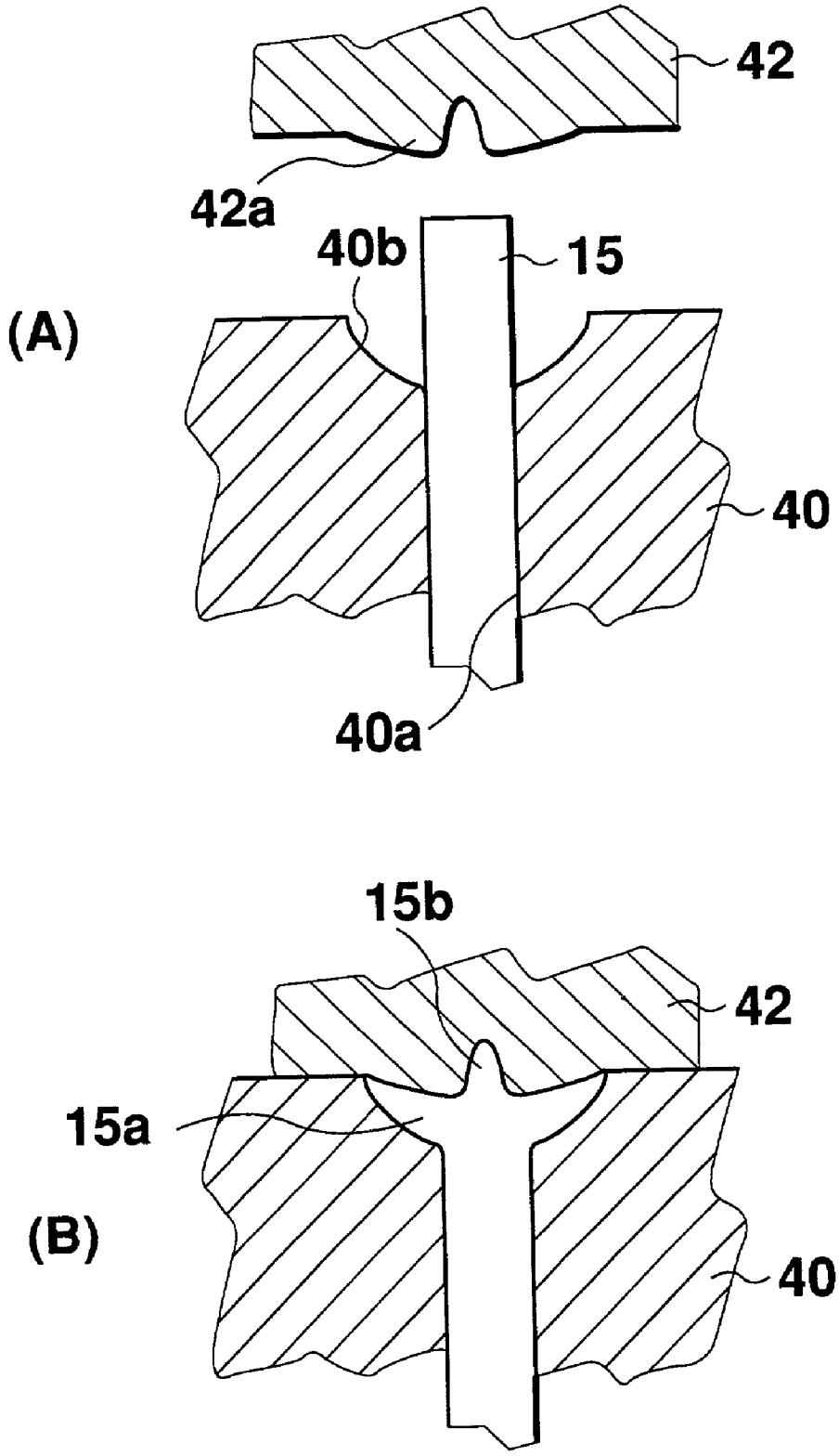
FIG. 5 is an explanatory diagram showing the method for processing the electrodes according to the first embodiment.

FIG. 5 shows an example processing method for obtaining the tip shape of the discharge electrode 15 as shown in FIG. 3.

As shown in FIG. 5A, the discharge electrode 15 is supported within a supporting hole 40*a* of the lower mold 40. A receiving mold 40*b* having a plate-like shape is provided in the lower mold 40 around the supporting hole 40*a*. On the other hand, a press mold 42*a* is provided at the upper mold 42 to correspond with the receiving mold to press the plate-like section 15*a* and projecting section 15*b* onto the discharge electrode 15.

Therefore, as shown in FIG. 5A, the discharge electrode 15 is pressed by the lower and upper molds 40 and 42 in a condition where the discharge electrode 15 is fixed to the lower mold 40, to easily form the plate-like section 15*a* and the projecting section 15*b* at the tip of the discharge electrode 15, as shown in FIG. 5B.

Figure 6:
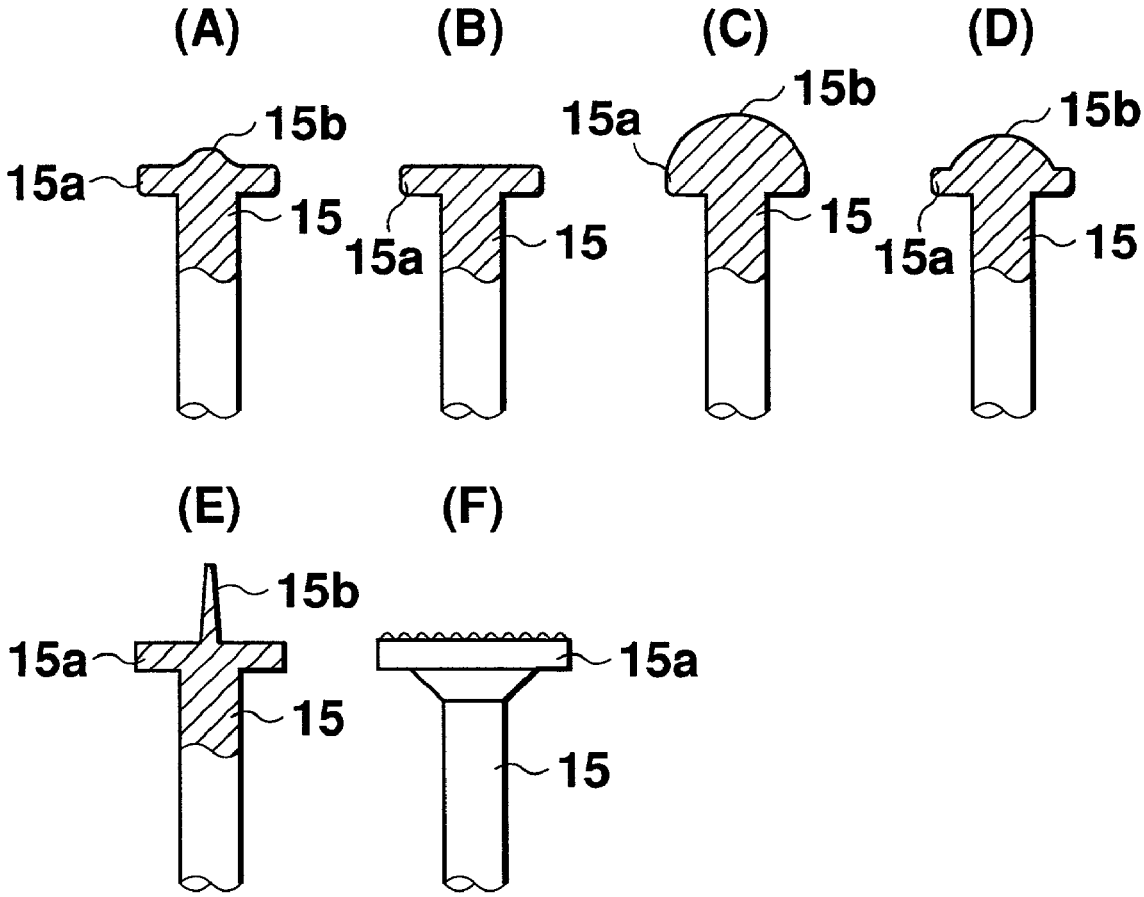
FIG. 6 shows additional examples of discharge electrodes of the first embodiment.

FIG. 6 shows shapes of various discharge electrode used in the present invention. FIG. 6A shows an example where the plate-like section 15*a* has a flat upper surface and the projecting section 15*b* has a semispherical shape. FIG. 6B shows an example where the plate-like section 15*a* has a flat upper surface with no projecting section 15*b*. FIG. 6C shows an example where the upper surface of the plate-like section 15*a* is formed to have a large spherical shape. FIG. 6D shows an example where a relatively large projecting section 15*b* is provided on the plate-like section 15*a*. FIG. 6E shows an example where a thin projecting section 15*b* is formed on the plate-like section 15*a* having a flat upper surface. FIG. 6F shows an example of a discharge electrode where small projection-like sections are provided on the upper surface of the plate-like section 15*a*, and where any one of the projection-like sections can provide a stable discharge starting effect.

Any of the discharge electrode shapes can be arbitrarily selected. It is also possible to have either one or both of the opposing discharge electrodes as any of the shapes shown in FIG. 6. Alternatively, it is possible to have a combination of the shape as shown in FIG. 3 or to have one discharge electrode 14 as a rod shape, as will be described for the second embodiment.

As described, according to the first embodiment of the present invention, the illuminant 10 which forms a main part of the discharge lamp is constructed by inserting discharge electrodes fixed to respective sealing spacers into both ends of the housing formed from a cylindrical transparent material and the discharge electrodes 14 and 15 are placed to have a predetermined gap in between and to oppose each other. Because of this, the axes of the electrodes 14 and 15 can be accurately coaxially placed, and, thus, the light source position of the illuminant can be accurately set. According to the present invention, the positioning of the discharge electrodes 14 and 15 is performed by the sealing spacers 16 and 17 having the position adjustable in the axial direction within the housing 13. Thus, as described, a coaxial placement is possible, and, at the same time, the gap between the discharge electrodes 14 and 15 can be arbitrarily selected and adjusted.

Therefore, according to an illuminant of the present invention, optimum characteristics can be given to various discharge lamps. In particular, the present invention allows for obtaining a suitable illuminant for a lamp of a car or a lamp for a cinematograph or for a projector or the like, in which the light source position must be precisely regulated.

Figure 7:
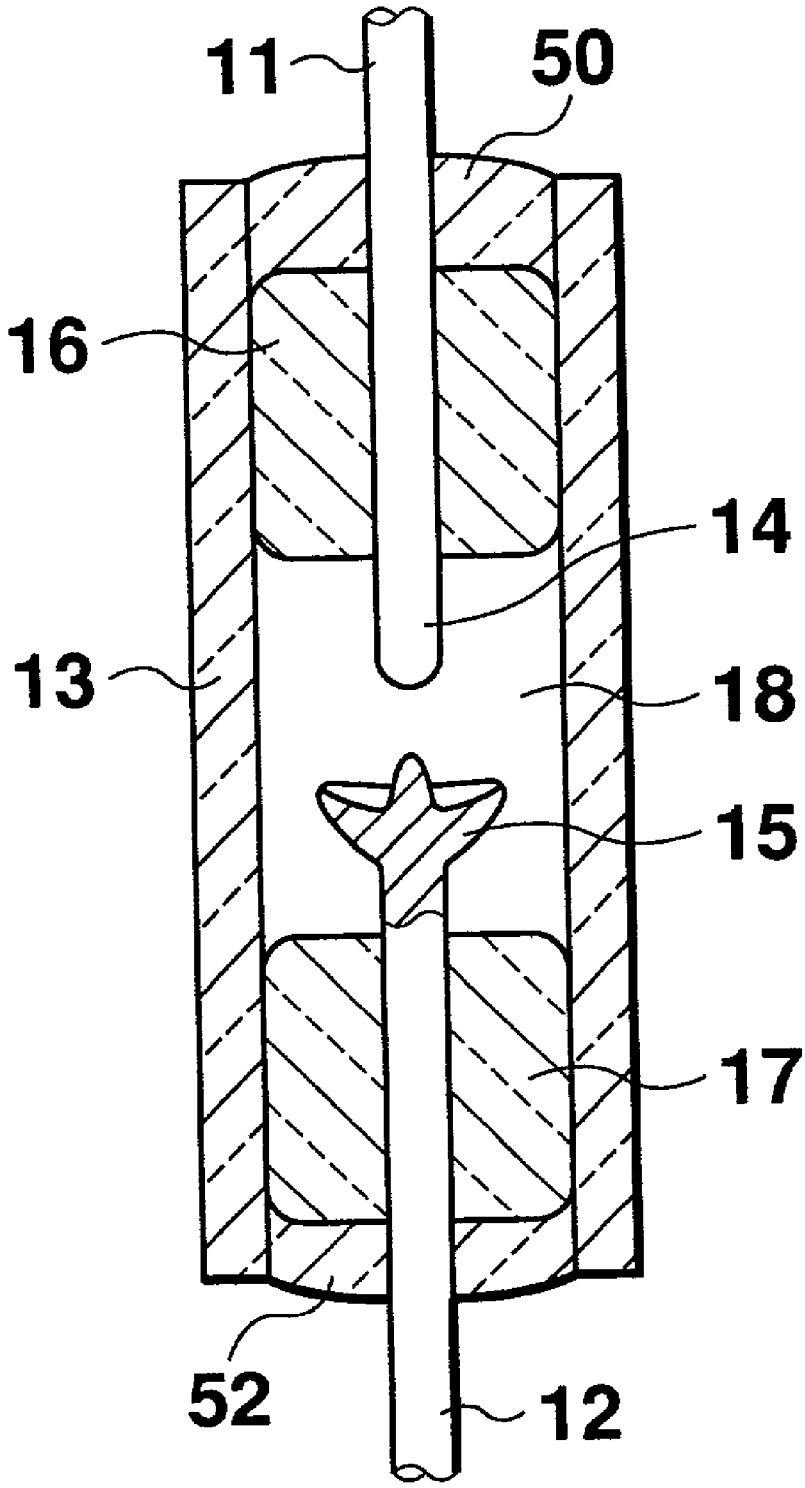
FIG. 7 is a cross-sectional diagram of an illuminant according to a second embodiment of the present invention.

FIG. 7 shows a second preferred embodiment of the illuminant for a discharge lamp according to the present invention. The structures identical to those shown in FIG. 3 of the first embodiment are referred to by the same reference numerals and will not be described again here.

In the second embodiment, the sealing spacers 16 and 17 with respective discharge electrode axes 11 and 12 fixed are firmly fixed to the housing 13 by an adhesive. In other words, as is clear from FIG. 7, adhesives 50 and 52 are introduced to both ends of the housing 13 in a condition where the sealing spacers 16 and 17 are positioned in the housing 13, to seal and fix the sealing spacers 16 and 17 and the housing 13 by the solidification of the adhesive. In the second embodiment, it is possible to combine and use arbitrary shapes for the discharge electrodes 14 and 15 as shown in FIG. 6. The second embodiment is advantageous in that there is no necessity to heat the sealing spacers 16 and 17 and the housing 13, and thus, avoids thermal deformation.

Figure 8:
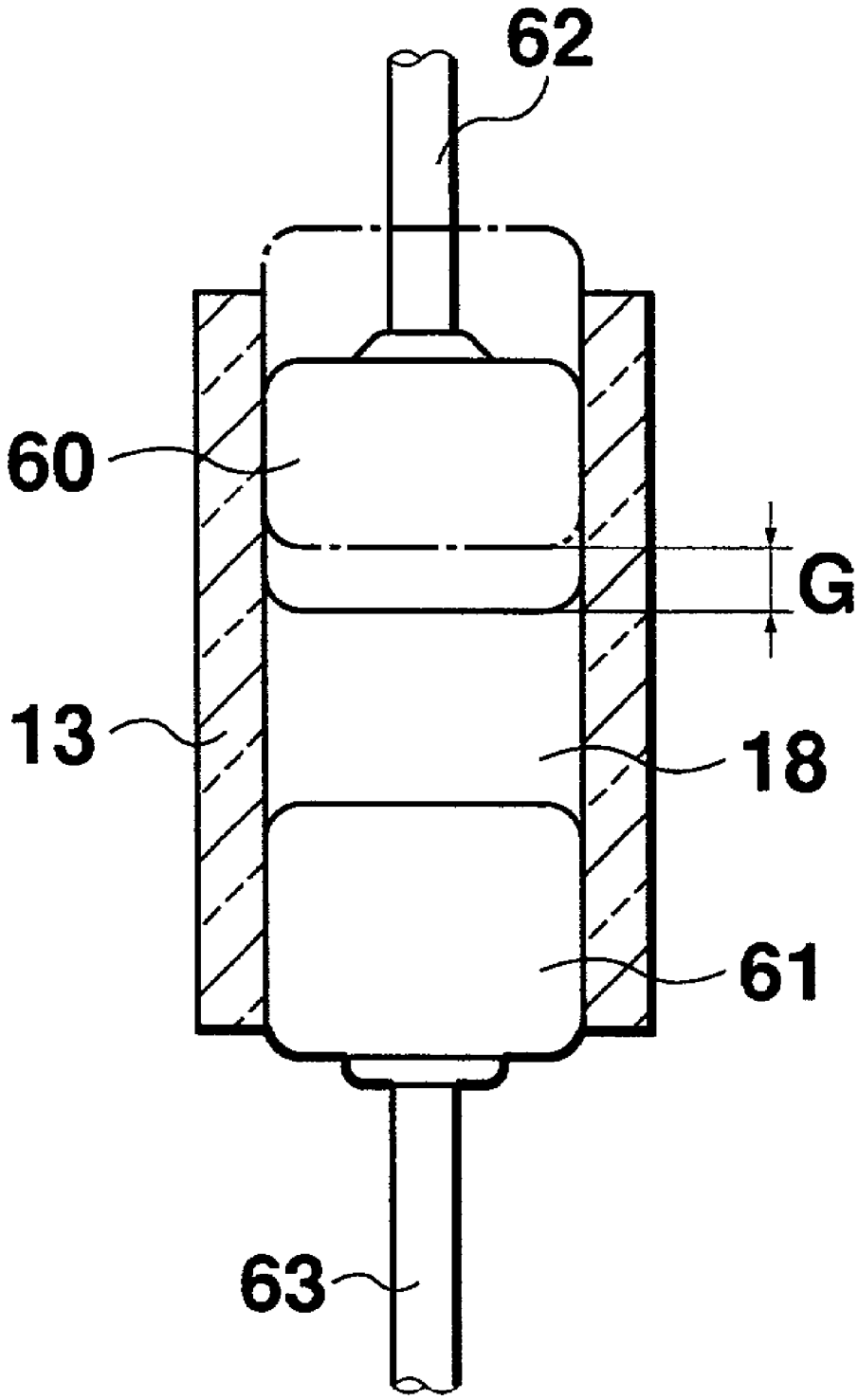
FIG. 8 is a cross-sectional diagram of an illuminant according to a third embodiment of the present invention.

FIG. 8 shows a discharge illuminant according to a third embodiment of the present invention.

In the third embodiment, unlike the first and second embodiments, the discharge electrodes are directly sealed and fixed to the housing without sealing spacers.

The housing 13 is identical to those in the other embodiments. However, the discharge electrodes 60 and 61 themselves have an outer radius approximately equal to the inner radius of the housing 13 and the fixing positions can be freely adjusted in the axial direction within the housing 13. Lead lines 62 and 63 are respectively fixed to the discharge electrodes 60 and 61. The fixture between the discharge electrodes 60 and 61 and the housing 13 is preferably heat fusion of the housing. To this end, it is preferable to construct the discharge electrodes 60 and 61 by dumet, and in this case, it is also possible to form the lead lines 62 and 63 as dumet and as an integrated structure with the discharge electrodes. It is also possible to use other metal conductors for the lead lines 62 and 63 such as, for example, iron and iron alloy.

As shown in FIG. 8, the position of at least one discharge electrode 60 can be adjusted along the axial direction of the housing 13, as shown by letter G. The housing 13 and the discharge electrodes 60 and 61 can be fused by heating the housing 13 to a temperature of 350~850° C. in a condition where the discharge electrodes 60 and 61 are held with a predetermined gap in between.

With the third embodiment, because the position of the discharge electrodes 60 and 61 can be arbitrarily adjusted when inserted into the housing 13, it is possible, by adjusting the gap length, to construct various illuminants with various characteristics using a same housing 13 and same discharge electrodes 60 and 61. Moreover, because the discharge electrodes 60 and 61 are formed so that the outer radius of the discharge electrodes is approximately equal to or slightly smaller than the inner radius of the housing 13, assembly or manufacturing is relatively very simple.

Figure 9:
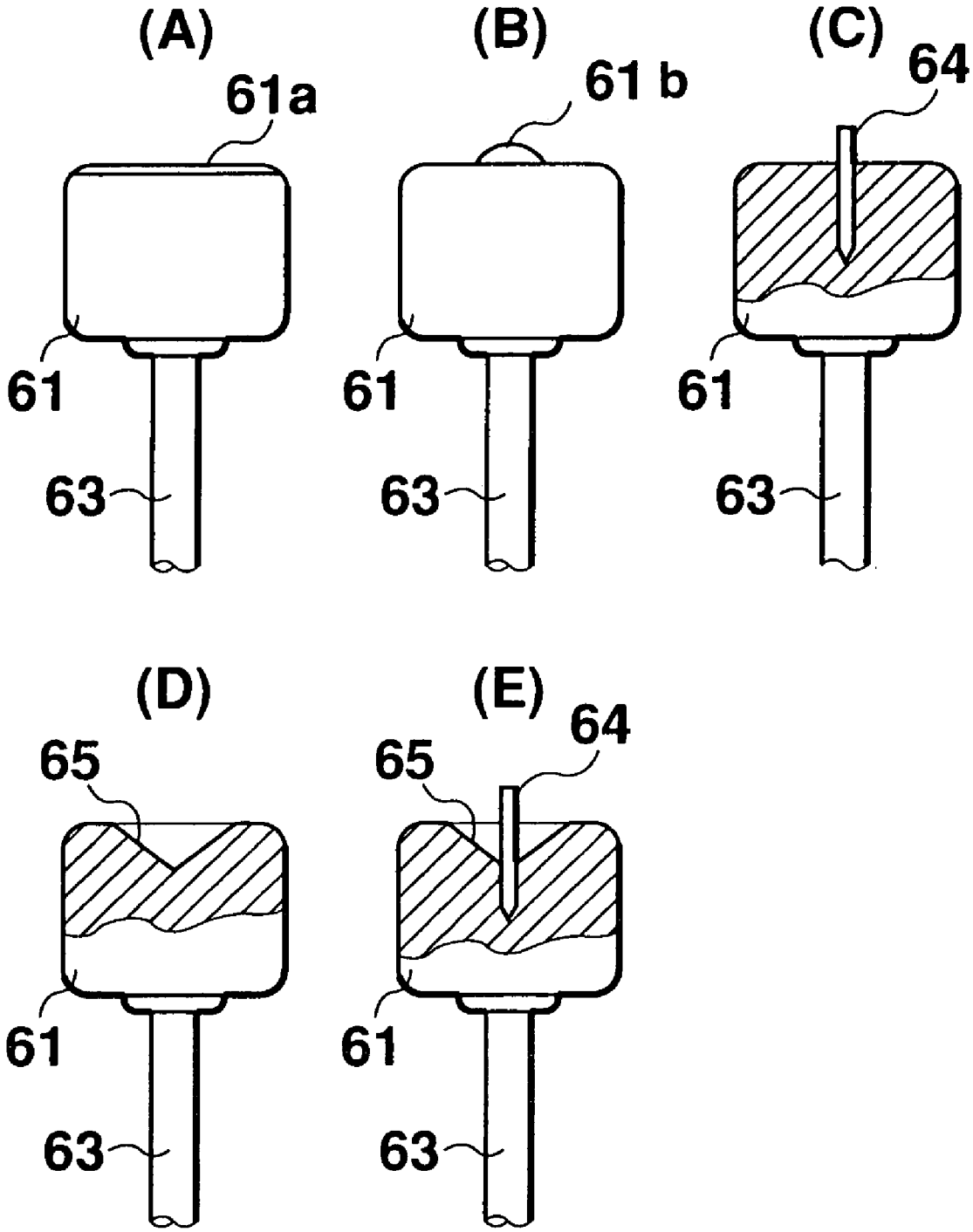
FIG. 9 shows additional example shapes of the discharge electrode of the third embodiment.
Figure 10:
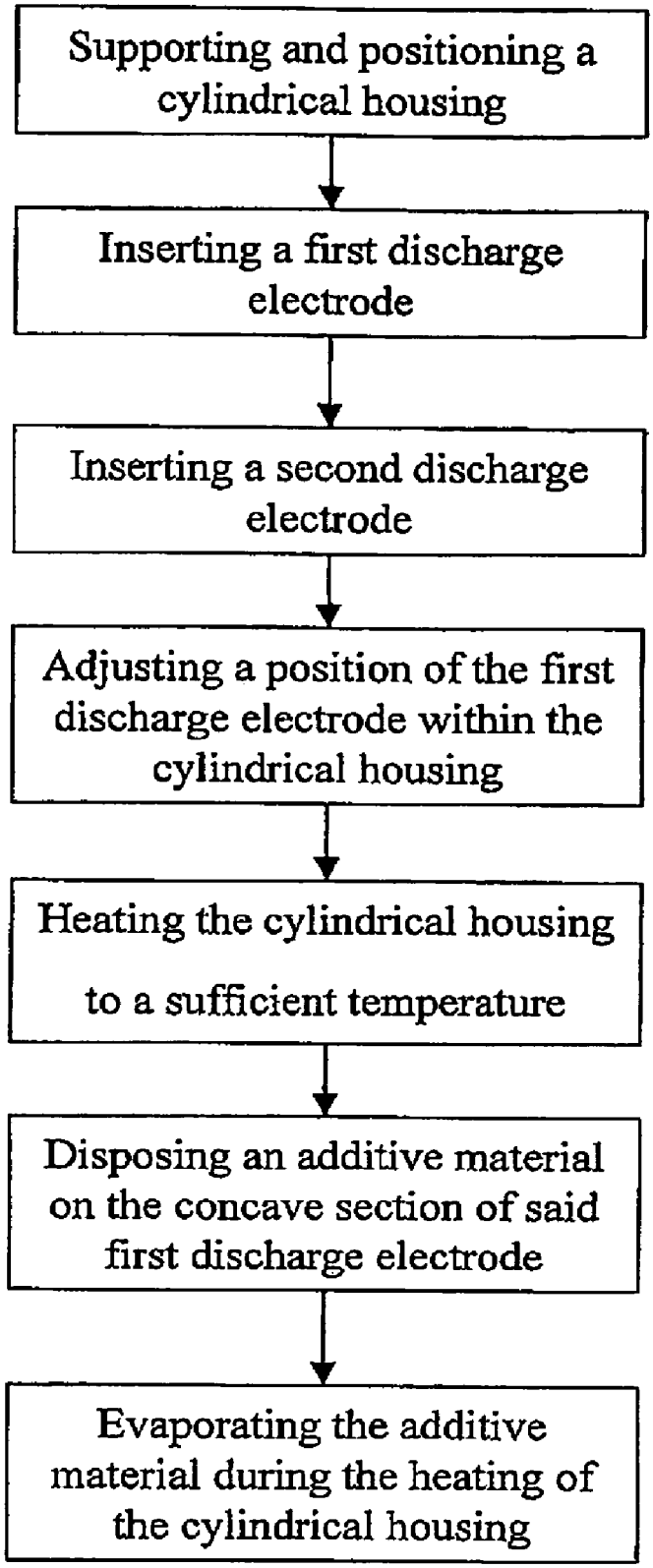
FIG. 10 depicts a block diagram of an exemplary embodiment of a method of assembling an illuminant for a discharge lamp.
Figure 11:
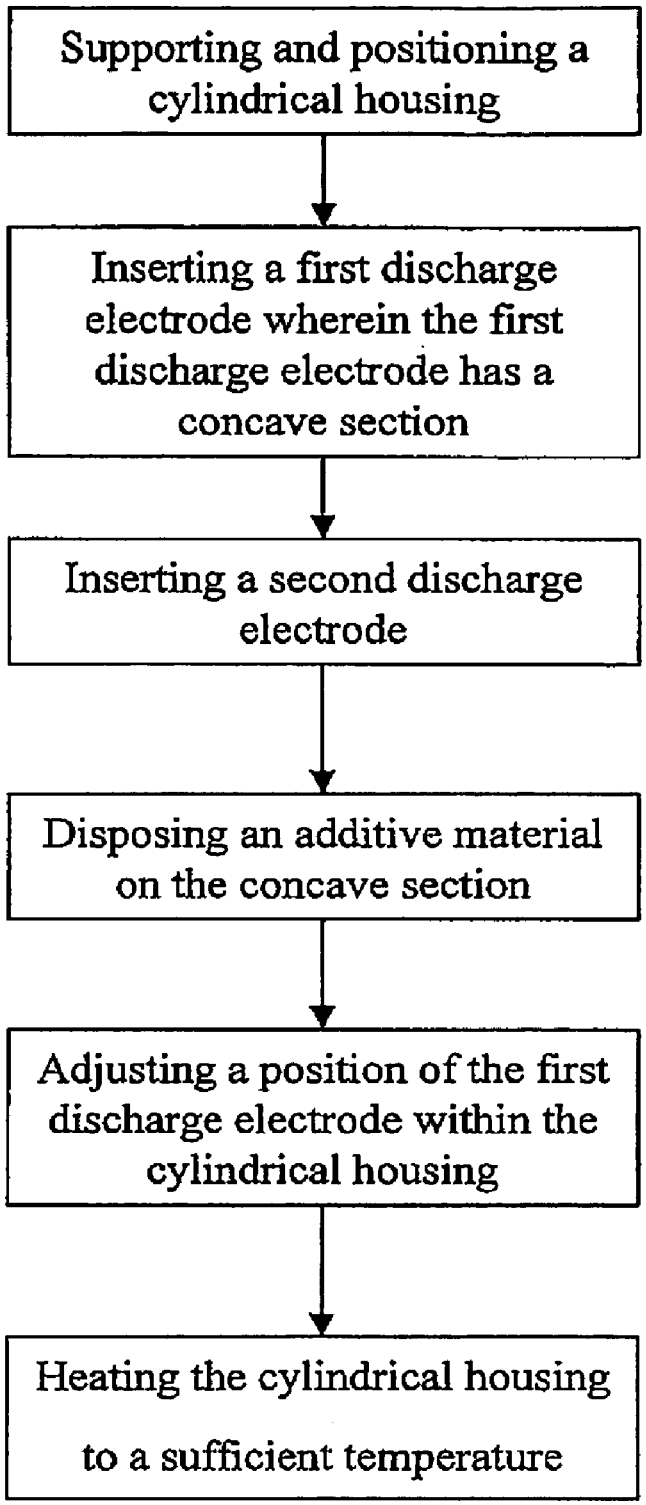
FIG. 11 depicts a block diagram of an exemplary embodiment of a method of manufacturing an illuminant for a discharge lamp.

FIG. 9 shows various example shapes for the discharge electrodes 60 and 61 used in the third embodiment.

FIG. 9A shows an example where an alumina coating 61*a* is formed on the discharge surface of the discharge electrode 61, in order to lower the starting voltage. FIG. 9B shows an example where a projecting section 61*b* is provided at the center of the upper surface of the discharge electrode 61 for facilitating start-up of discharge. FIG. 9C shows an example where a discharge needle 64 is embedded at the center of the upper surface of the discharge electrode 61, in which a stable discharge starting capability can be obtained by starting the discharge from the discharge needle 64. FIG. 9D shows an example where a conical recess 65 is provided at the upper surface of the discharge electrode 61, in which the ring-shaped section at the upper surface of the electrode 61 performs the discharge effect to obtain stable and high luminance discharge. FIG. 9E shows an example where the discharge needle 64 shown in FIG. 9C is embedded into the recess 65 shown in FIG. 9D, in which discharge and discharge start-up can be stably performed.

As described, according to the present invention, an illuminant having a simple, easily mass-produced structure and high durability can be obtained. Thus, an inexpensive illuminant having a stable performance can be provided.

In the present invention, the inner radius of the housing can be arbitrarily selected for various discharge power to obtain illuminants with different characteristics. For example, a transparent housing, such as a glass diode container, with various inner radii such as, 1.66 mm (5 W), 2.0 mm (8 W), 2.6 mm (10 W), 3.1 mm (20 W), 4.3 mm (30 W), 5.3 mm (35~40 W), 6.5 mm (60 W), and 8.0 mm (80~150 W), can be used according to the desired discharge power.

The illuminant according to the present invention also has different characteristics depending on the gap between the electrodes, and experiments have shown that a wide range of emitting characteristics can be provided by arbitrarily selecting a discharge gap between 0.07 and 6 mm.

As known in the art, the amount of additional material, such as, for example, mercury, significantly affects the discharge characteristics. However, in the present invention, by changing the size of the plate-like section provided on at least one of the electrodes, the amount of additive mercury can be varied. Experiments have shown that stable discharge characteristics can be obtained by arbitrarily adjusting the amount of mercury between 0.04 and 3.00 mg by adjusting the size of the plate-like section.

What is claimed is:

1. A method of assembling an illuminant for a discharge lamp, comprising:

supporting and positioning a cylindrical housing comprising a first open end and a second open end;

inserting a first discharge electrode into the first open end, said discharge electrode comprising a concave section;

inserting a second discharge electrode into the second open end;

adjusting a position of the first discharge electrode within the cylindrical housing relative to the second discharge electrode such that first discharge electrode is opposed to the second discharge electrode and a predetermined gap is formed between the first discharge electrode and the second discharge electrode;

heating the cylindrical housing to a sufficient temperature to fix each of the first discharge electrode and the second electrode to the cylindrical housing such that the predetermined gap is maintained;

disposing an additive material on the concave section of said first discharge electrode;

evaporating the additive material during the heating of the cylindrical housing; and wherein the cylindrical housing is supported and positioned in a vertical position.

2. A method of assembling an illuminant for a discharge lamp, comprising:

supporting and positioning a cylindrical housing comprising a first open end and a second open end;

inserting a first discharge electrode pre-affixed to a first sealing spacer into the first open end, said first discharge electrode comprising a concave section;

inserting a second discharge electrode pre-affixed to a second sealing spacer into the second open end;

adjusting a position of the first discharge electrode within the cylindrical housing relative to the second discharge electrode such that first discharge electrode is opposed to the second discharge electrode and a predetermined gap is formed between the first discharge electrode and the second discharge electrode;

heating the cylindrical housing to a sufficient temperature to fix each of the first sealing spacer and the second sealing spacer to the cylindrical housing such that the predetermined gap is maintained;

disposing an additive material on the concave section of said first discharge electrode;

evaporating the additive material during the heating of the cylindrical housing; and wherein the cylindrical housing is supported and positioned in a vertical position.

3. A method of manufacturing an illuminant for a discharge lamp, comprising:

supporting and positioning a cylindrical transparent housing in a vertical position, wherein the cylindrical transparent housing comprises a first open end and a second open end, and wherein the cylindrical transparent housing has equal inner radii at both the first open end and the second open end;

inserting a first discharge electrode pre-affixed to a first sealing spacer into the first open end, wherein the first discharge electrode has a concave section;

inserting a second discharge electrode pre-affixed to a second sealing spacer into the second open end, wherein each of the first sealing spacer and the second sealing spacer have an outer radius approximately equal to or slightly smaller than the inner radius of the cylindrical transparent housing;

disposing an additive material on the concave section;

adjusting a position of the first discharge electrode within the cylindrical housing relative to the second discharge electrode such that first discharge electrode is opposed to the second discharge electrode and a predetermined gap is formed between the first discharge electrode and the second discharge electrode; and heating the cylindrical housing to a sufficient temperature to fix each of the first sealing spacer and the second sealing spacer to the cylindrical housing such that the predetermined gap is maintained, and such that the additive material is evaporated.

* * * * *